US008349089B2

(12) United States Patent
Bertsch et al.

(10) Patent No.: US 8,349,089 B2
(45) Date of Patent: Jan. 8, 2013

(54) DISHWASHER HAVING DEDICATED SPRAYER FOR SILVERWARE BASKET

(75) Inventors: Roger James Bertsch, Stevensville, MI (US); David Hung-Chih Chen, Saint Joseph, MI (US); Brian Lee Greenhaw, Berrien Center, MI (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 265 days.

(21) Appl. No.: 12/266,811

(22) Filed: Nov. 7, 2008

(65) Prior Publication Data

US 2010/0116296 A1 May 13, 2010

(51) Int. Cl.
*B08B 9/20* (2006.01)

(52) U.S. Cl. ..... 134/25.2; 134/18; 134/25.1; 134/33; 134/34; 134/35; 134/36; 134/42; 134/94.1; 134/99.1; 134/135; 134/184; 134/200

(58) Field of Classification Search ..... 134/18, 134/25.1, 25.2, 33, 34, 35, 36, 42, 94.1, 99.1, 134/135, 184, 200
See application file for complete search history.

(56) References Cited

U.S. PATENT DOCUMENTS

| | | | | |
|---|---|---|---|---|
| 1,897,821 | A | 2/1933 | Poli | |
| 2,012,178 | A * | 8/1935 | Anderson | 239/66 |
| 2,596,693 | A | 5/1952 | Karlstrom | |
| 3,288,155 | A * | 11/1966 | Swetnam | 134/176 |
| 3,319,640 | A * | 5/1967 | La Flame | 134/139 |
| 3,468,486 | A * | 9/1969 | Mercer | 239/251 |
| 3,708,120 | A * | 1/1973 | Camprubi et al. | 239/66 |
| 3,779,258 | A * | 12/1973 | Brenner et al. | 134/138 |
| 3,890,987 | A | 6/1975 | Marcussen et al. | |
| 3,941,139 | A * | 3/1976 | Spiegel | 134/176 |
| 4,784,168 | A * | 11/1988 | Erminio | 134/100.1 |
| 5,331,986 | A * | 7/1994 | Lim et al. | 134/88 |
| 5,655,740 | A | 8/1997 | Lazarus | |
| 5,882,739 | A * | 3/1999 | Kobos et al. | 427/536 |
| 5,964,232 | A * | 10/1999 | Chung | 134/176 |
| 6,003,529 | A * | 12/1999 | Perry, Jr. | 134/56 D |
| 7,100,623 | B2 | 9/2006 | Assmann et al. | |
| 2002/0185166 | A1 * | 12/2002 | Rosenbauer et al. | 134/200 |
| 2004/0173249 | A1 * | 9/2004 | Assmann et al. | 134/94.1 |
| 2005/0109378 | A1 * | 5/2005 | Landsiedel et al. | 134/135 |
| 2005/0150529 | A1 * | 7/2005 | Vanderroest et al. | 134/135 |
| 2007/0006903 | A1 | 1/2007 | Koch et al. | |
| 2007/0056613 | A1 | 3/2007 | Haas et al. | |
| 2009/0071514 | A1 * | 3/2009 | Roth | 134/56 D |
| 2009/0120474 | A1 * | 5/2009 | Kehl | 134/58 D |
| 2009/0159103 | A1 * | 6/2009 | Gillum et al. | 134/98.1 |
| 2009/0178698 | A1 * | 7/2009 | Delgado | 134/57 D |

FOREIGN PATENT DOCUMENTS

| | | | |
|---|---|---|---|
| DE | 7417444 | U | 10/1974 |
| EP | 1040786 | A1 * | 10/2000 |
| WO | 2004/019747 | A1 | 3/2004 |

* cited by examiner

*Primary Examiner* — Bibi Carrillo
(74) *Attorney, Agent, or Firm* — Jacquelyn R. Lin; McGarry Bair PC

(57) ABSTRACT

A method and apparatus for providing multiple spray zones to different subportions of a silverware basket within the wash chamber of a dishwasher.

19 Claims, 10 Drawing Sheets

DISHWASHER HAVING DEDICATED SPRAYER FOR SILVERWARE BASKET

BACKGROUND OF THE INVENTION

Automatic dishwashers are commonly found in household environments. A typical automatic dishwasher comprises a cabinet that defines a wash chamber, which is accessible through a moveable door. An upper and a lower rack for holding utensils to be cleaned are provided within the wash chamber. A silverware basket for holding utensils, silverware, etc. is also usually provided and normally removably mounts to the door or within the lower rack. The silverware basket is configured to hold elongated utensils such as knives, spoons, forks, spatulas in a vertical orientation as well as smaller objects that might fall through racks.

Liquid is sprayed into the upper and lower racks and the silverware basket to clean any utensils they contain. Rotating spray arms arranged below each rack and spraying upwardly through the bottom of the corresponding rack delivers the liquid to the utensils. The liquid spray pattern is generally in the form of a circle when viewed in planform. The velocity of the liquid exiting the spray arm tends to drop off from the center of the spray arm to the ends of the spray arm.

The silverware basket tends to receive less liquid from the spray arms and tends to receive the lower velocity liquid because the silverware basket is located at the periphery of the spray pattern. The volume and velocity of the sprayed liquid reaching the silverware basket are further reduced in that the liquid must pass through the structure of the lower rack as well as the structure of the silverware basket. All of which leads to reduced cleaning performance for utensils in the basket relative to utensils in the lower rack.

SUMMARY OF THE INVENTION

The invention relates to an automatic dishwasher with a dedicated sprayer for a silverware basket having multiple spray zones, each spray zone directed toward a different subportion of the silverware basket.

The invention further relates to a method for delivering liquid to a silverware basket by repeatedly emitting a spray of liquid from a dedicated sprayer toward different subportions of the silverware basket to spray the entire silverware basket with liquid.

DESCRIPTION OF THE INVENTION

Figure 1:
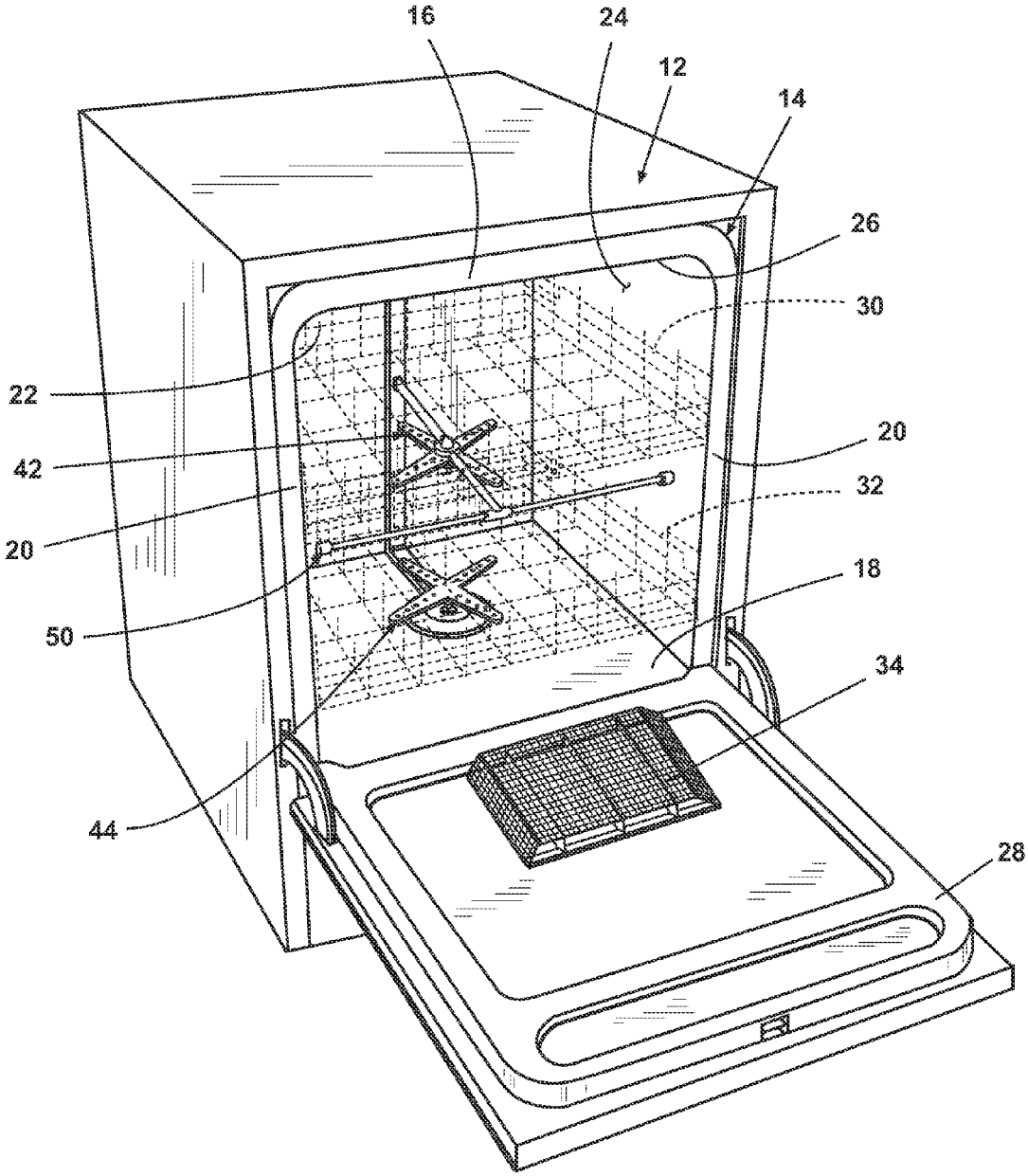
FIG. 1 is a perspective view of a first embodiment of an automatic dishwasher, with a dedicated sprayer for a silverware basket in accordance with the invention.

FIG. 1 is a perspective view of an automatic dishwasher 10 in accordance with a first embodiment of the invention. As illustrated, the dishwasher 10 includes a housing 12 for enclosing a wash tub 14. The dishwasher 10 shares many features of a conventional automatic dishwasher, which will not be described in detail herein except as necessary for a complete understanding of the invention. The wash tub 14 has spaced top and bottom walls 16 and 18, spaced side walls 20, and a rear wall 22. The walls 16, 18, 20, and 22 join along their respective edges to define a wash chamber 24 with an access opening in the form of an open face 26. A door 28 is hingedly mounted to the housing 12 and can move between an opened position, as illustrated in FIG. 1, to provide access to the wash chamber 24 and a closed position (shown in FIG. 2) to close the wash chamber 24 by covering the open face 26 of the wash chamber 24. Typically, the door 28 is in the opened position when utensils are loaded or unloaded into the dishwasher 10 and in the closed position while the washing cycle is running or while the dishwasher 10 is not in use.

Utensil holders (shown in phantom in FIG. 1 for clarity of the surrounding structure) in the form of upper and lower racks 30, 32 are located within the wash chamber 24 and receive utensils for washing. The racks 30, 32 are typically mounted for slidable movement in and out of the wash chamber 24 for ease of loading and unloading. Another utensil holder in the form of a silverware basket 34 is located in the wash chamber 24. As illustrated, the silverware basket 34 is located on the door 28, and may be removably mounted. Optionally, the silverware basket 34 could be mounted to the lower rack 32 or the upper rack 30. In yet another option, the silverware basket 34 could comprise a separate shallow rack positioned in the wash chamber 24, above or below either of the rack 30, 32.

Utensil holders 30, 32, 34 all hold various utensils for washing within the wash chamber. As used in this description, the term utensil is generic to dishes and the like that are washed in the dishwasher 10 and expressly includes, dishes, plates, bowls, silverware, glassware, stemware, pots, pans, and the like.

Figure 2:
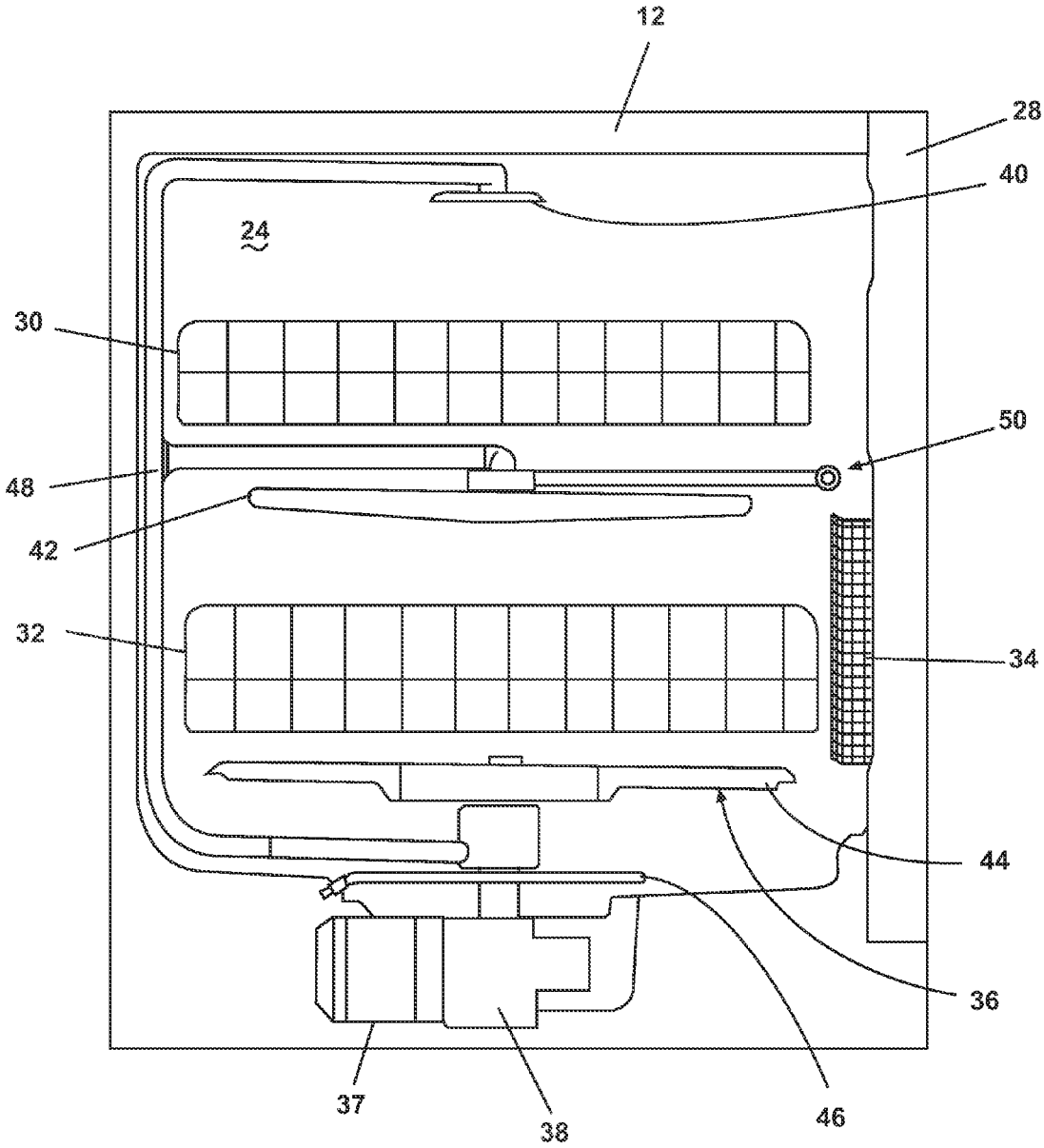
FIG. 2 is a schematic, side-sectional view of the dishwasher of FIG. 1.

FIG. 2 is a schematic, side-sectional view of the dishwasher of FIG. 1. The dishwasher 10 further includes a liquid circulation system 36 for introducing and circulating liquid and wash aids, such as detergents, rinse aids, and the like, throughout the wash chamber 24. The liquid circulation system 36 comprises a drain pump 37 and a recirculation pump 38 located in a lower portion or sump of the wash tub 14 and a sump heater 46 which acts to heat the liquid and is located in the lower portion of the dishwasher 10. The drain pump 37 pumps liquid to a household drain line (not shown). The recirculation pump 38 pumps liquid to sprayers 40, 42, 44. As illustrated, liquid is supplied to the sprayers 40 and 42 through a supply tube 48 that extends generally rearwardly from the recirculation pump 38 and upwardly along the rear wall 22 of the tub 14. While the supply tube 48 ultimately supplies liquid to the sprayers 40, 42, it may fluidly communicate with one or more manifold tubes that directly transport liquid to the sprayers 40, 42.

Sprayer 40 is located above the upper rack 30 and is illustrated as a fixed spray nozzle that sprays liquid downwardly within the wash chamber 24. Sprayers 42, 44 are located, respectively, beneath upper rack 30 and lower rack 32 and are illustrated as rotating spray arms. The upper spray arm 42 can be rotatably mounted to the bottom of the upper rack 30 and can provide a liquid spray upwardly through the bottom of the upper rack 30. The lower spray arm 44 can be rotatably mounted to the pump 38 beneath the lower rack 32 and can provide a liquid spray upwardly through the bottom of the lower rack 32. The upper spray arm 42 can optionally also provide a liquid spray downwardly onto the lower rack 32, but for purposes of simplification, this will not be illustrated herein.

In addition to the sprayers 40, 42, 44, all of which provide generalized sprays of liquid to the wash chamber 24, the dishwasher 10 includes a dedicated sprayer 50 for providing one or more sprays of liquid to the silverware basket 34.

Figure 3:
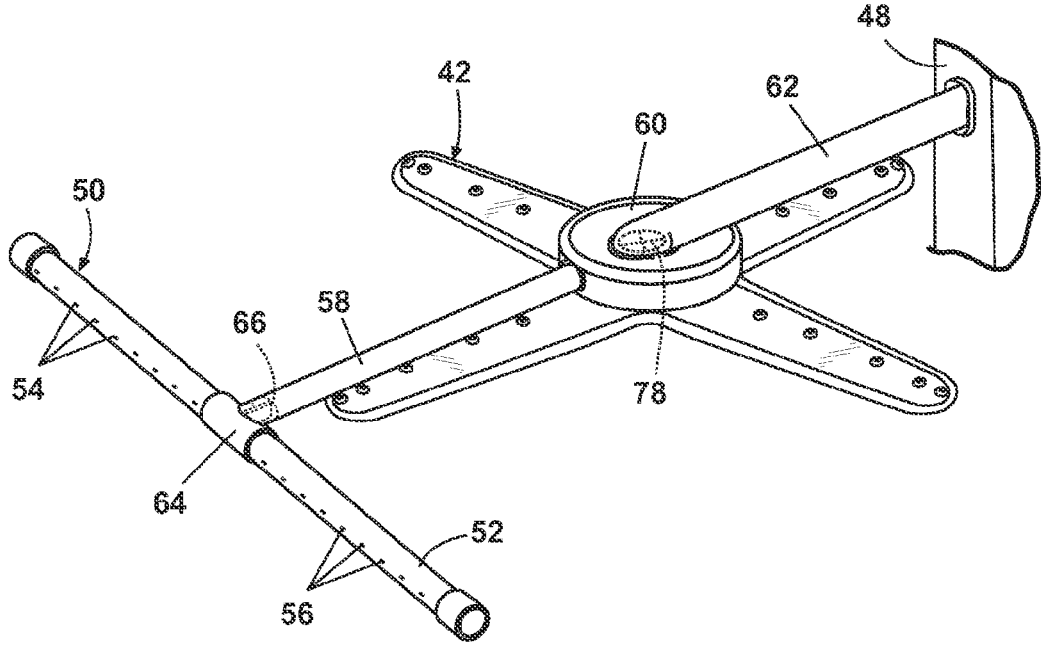
FIG. 3 is a perspective view of the dedicated sprayer of FIG. 1.

Referring to FIG. 3, the dedicated sprayer 50 may comprise a fixed, elongated spray head 52 having one or more nozzles or orifices 54, 56 for dispensing a stream of liquid forming a spray. The orifices 54, 56 can be configured to dispense one or more streams of wash liquid in different directions. The elongated spray head 52 extends generally horizontally between the side walls 20 of the cabinet 12 (FIG. 1) and can be vertically positioned above the top of the silverware basket 34. The spray head 52 is in fluid communication with a first manifold tube 58 coupled with a manifold hub 60, which is hollow and is, in turn, in fluid communication with the supply tube 48 via a second manifold tube 62. The supply tube 48, thus, supplies liquid to both the upper spray arm 42 and the dedicated sprayer 50. The spray head 52 can be physically mounted to an end of the first manifold tube 58 by a coupler 64, preferably near the mid-point of the spray head 52. The first set of orifices 54 can be formed in the spray head 52 to the left of the mid-point of the spray head 52 and a second set of orifices 56 can be formed in the spray head 54 to the right of the mid-point of the spray head 52.

Liquid can be simultaneously supplied to the upper spray arm 42 and the dedicated sprayer 50 during operation of the dishwasher 10 so that liquid is sprayed concurrently by the upper spray arm 42 and the dedicated sprayer 50. Alternately, as illustrated, a first valve 78 can be positioned in the manifold hub 60 and selectively controls liquid being delivered to the upper spray arm 42 and the dedicated sprayer 50. Many different control schemes for the valve 78 can be provided. The valve 78 can be controlled to direct all liquid from the manifold tube 62 to the upper spray arm 42 or to the dedicated sprayer 50, or to direct a portion of the liquid to each of the upper spray arm 42 and the dedicated sprayer 50, thereby simultaneously spraying liquid from each. The valve 78 can be adjustable to control the amount or ratio of liquid delivered to upper spray arm 42 and the dedicated sprayer 50. The valve 78 can be controlled so the upper spray arm 42 and the dedicated sprayer 50 are alternately supplied with liquid in a repeating cycle. The valve 78 can be controlled so that spray of liquid from the upper spray arm is continuously emitted while the spray of liquid from the dedicated sprayer is selectively emitted. The control scheme for the valve 78 can be automatically controlled by a controller of the dishwasher 10, or can be user-controllable, such as by selecting a cycle of operation for the dishwasher via a control panel, as is common in the art.

A second valve 66 can be positioned in the spray head 52 or the first manifold tube 58 to direct liquid to the first set of orifices 54 or the second set of orifices 56. The valve 66 can be electrically or mechanically actuated. The valve 66 can be a sequencing diverter valve that takes a portion of the liquid supplied to the upper spray arm and directs it to a subportion of the silverware basket. The valve 66 can be controlled to repeatedly cycle between the first and second set of orifices 54, 56 during a portion of or during the entire wash cycle of the dishwasher.

The dedicated sprayer 50 may also be carried by the upper rack 30, above or below a bottom wall of the upper rack 30, or adjacent a peripheral side of the upper rack 30. As illustrated, the dedicated sprayer 50 is positioned below the bottom wall of the upper rack 30. One or more suitable fixation means (not shown) can mount the upper spray arm 42 and/or the dedicated sprayer 50 to the upper rack 30. Alternately, the dedicated sprayer 50 may be mounted separately from the upper rack 30.

Figure 4:
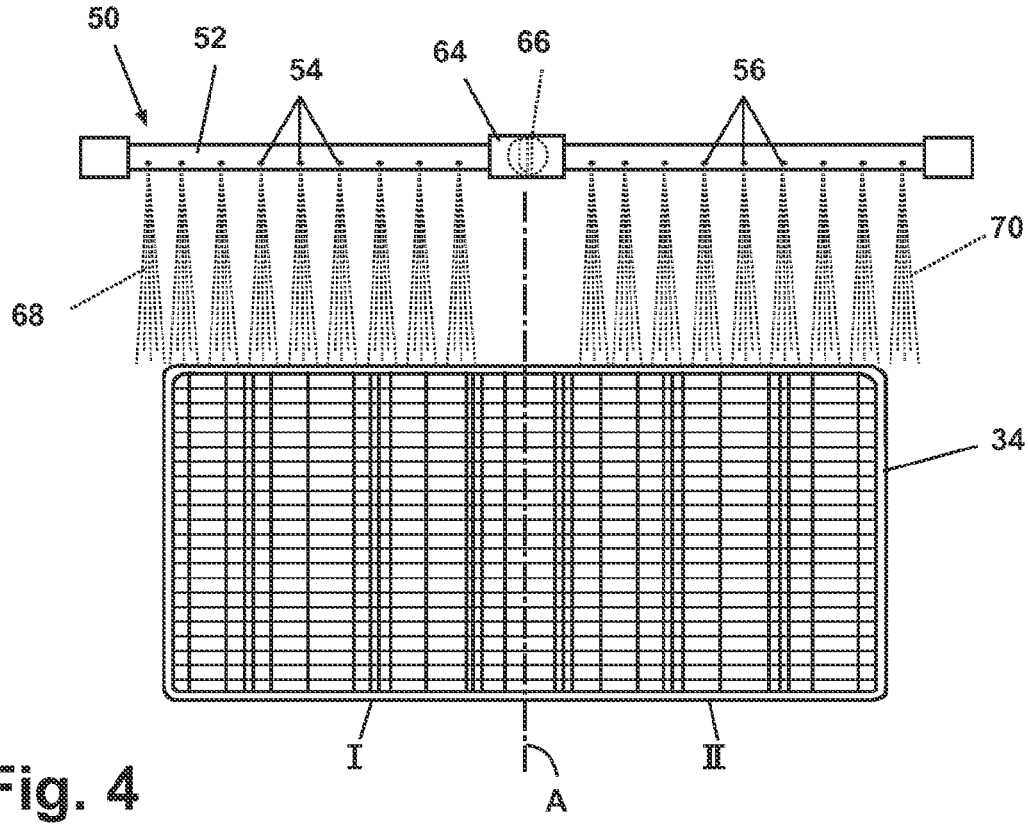
FIG. 4 is a schematic front view of the dedicated sprayer and the silverware basket, illustrating the spray zones of the dedicated sprayer of FIG. 1.
Figure 5:
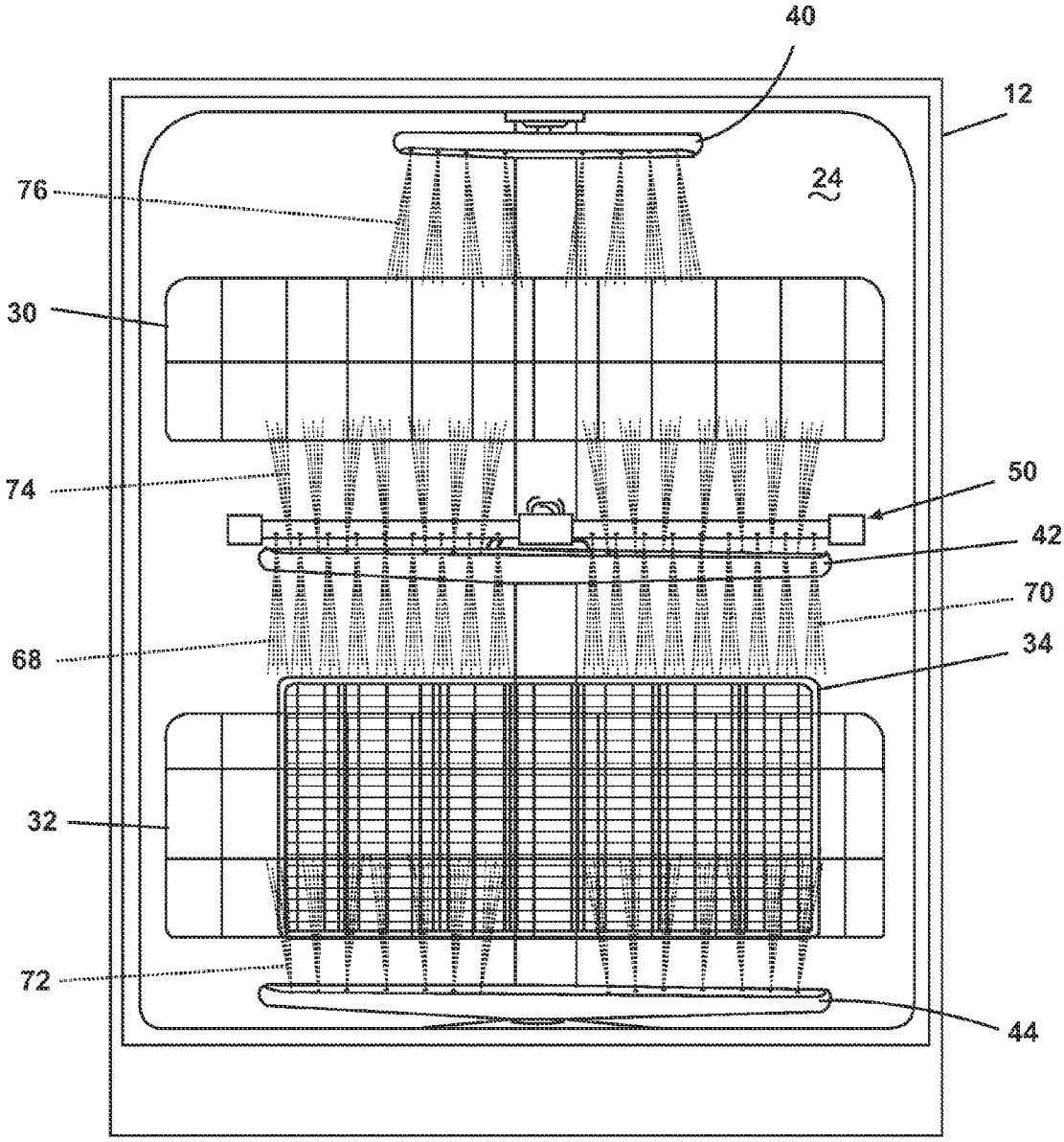
FIG. 5 is a schematic, front-perspective view of the dishwasher of FIG. 1, illustrating several spray zones in the wash chamber.
Figure 6:
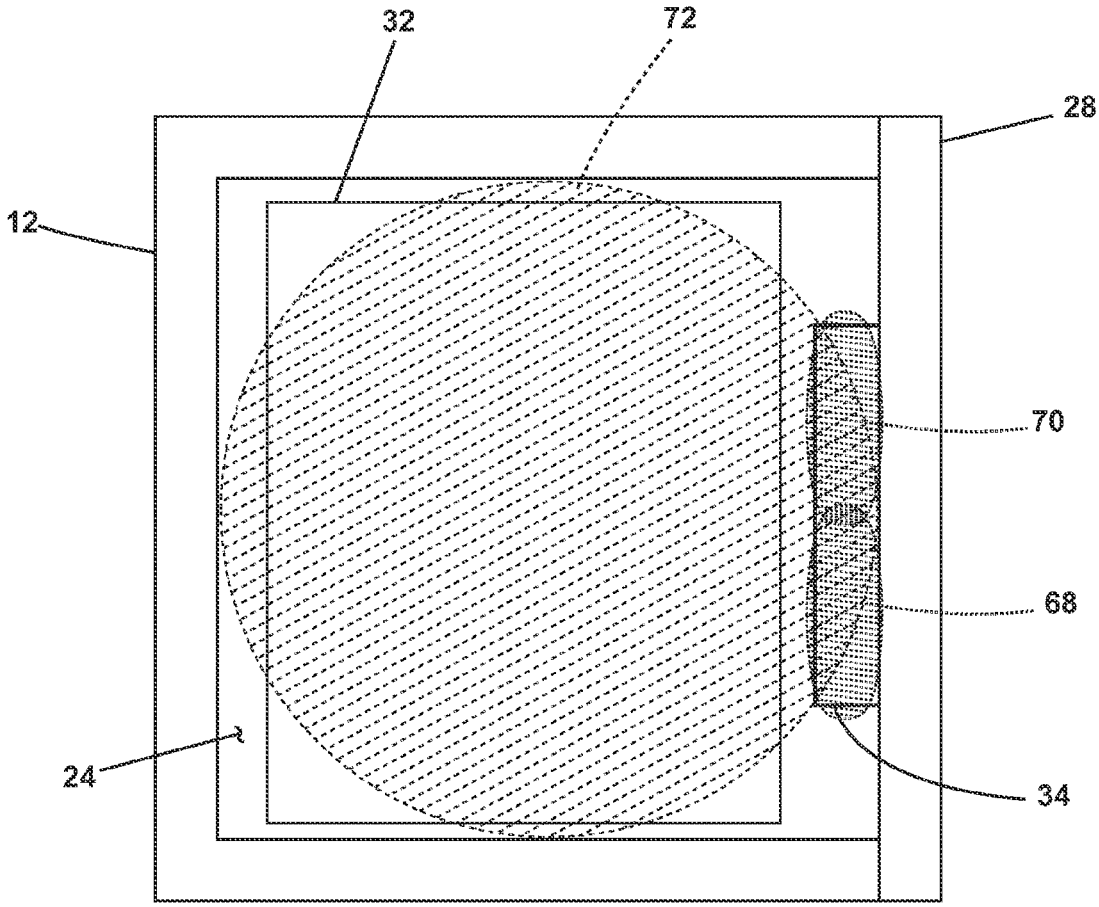
FIG. 6 is a schematic, sectional view through a lower rack and the silverware basket of the dishwasher, illustrating the spray zones of the lower rack and silverware basket from FIG. 5.

FIGS. 4-6 schematically illustrate several spray zones in the wash chamber 24. It is understood that the spray zones are not necessarily drawn to scale, and may be disproportionate to each other and to other features of the dishwasher 10. Referring to FIG. 4, the spray zones of the dedicated sprayer 50 for the silverware basket 34 are shown. Conceptually, the silverware basket 34 can be divided into different subportions. As shown in FIG. 4, the silverware basket 34 is divided into a first subportion I and a second subportion II as indicated by a plane A extending through the silverware basket 34. The dedicated sprayer 50 has multiple spray zones, each spray zone directed to a different subportion of the silverware basket 34. In the illustrated example, the dedicated sprayer will have two spray zones, one for each subportion I, II. The first set of orifices 54 dispense a stream of wash liquid toward the first subportion I to form a first silverware spray zone 68 and the second set of orifices 56 dispense streams of wash liquid toward the second subportion II to form a second silverware spray zone 70. The streams of wash liquid from the orifices 54, 56 can provide discrete sprays of liquid toward the silverware basket 34 to define the silverware spray zones 68, 70.

The valve 66 can selectively control which orifices 54, 56 receive liquid, and therefore controls which silverware spray zone 68, 70 is active. The valve 66 can be controlled to cycle between the two silverware spray zones 68, 70 so that a spray of liquid is selectively emitted from the dedicated sprayer 50 towards the different subportions I, II of the silverware basket 34. Thus, the entire silverware basket 34 can be sprayed with liquid, but liquid is directed to only one subportion at a time.

Generally, there is a constant volume of wash liquid supplied to the upper spray arm 42. When a portion of that volume is redirected to the dedicated sprayer 50, less wash liquid is supplied to the upper spray arm 42. By delivering liquid to one subportion of the silverware basket 34 at a time, the velocity of the emitted spray of liquid will be greater than if liquid were delivered to the entire silverware basket 34 at once. This can result in improved cleaning performance for not only the utensils in the silverware basket 34, but for the utensils in the upper rack 20 as well, since less wash liquid may be needed to achieve a sufficient spray of liquid, therefore requiring less wash liquid to be diverted from the upper spray arm 42 to the dedicated sprayer 50. Thus, the velocity of the spray of liquid emitted from the upper spray arm 42 may be less diminished than if liquid were delivered to the entire silverware basket 34 at once. Since the silverware spray zones 68, 70 can be been designed to enable the spray of liquid to be emitted at a greater velocity towards the silverware basket, the dishwasher 10 may not only provide better washing performance for silverware, but may provide overall improved wash performance since the design enables enable the spray of liquid from the upper spray arm 42 to be emitted at a greater velocity as well.

Referring to FIG. 5-6, the lower spray arm 44 can provide a liquid spray upwardly through the bottom of the lower rack 32 to define a first generalized spray zone 72 for the entire lower rack 32. The upper spray arm 42 can provide a liquid spray upwardly through the bottom of the upper rack 30 to define a second generalized spray zone 74 for the entire upper rack 30. The fixed spray nozzle 40 can provide a downwardly-directed liquid spray to define a third generalized spray zone 76 for the wash chamber 24, particularly the upper rack 30.

The silverware spray zones 68, 70 may intersect with the first generalized spray zone 72 for a combined washing action for each subportion of the silverware basket 34, as indicated by the intersecting zones 68, 70, 72 in FIG. 6. The silverware basket 34 can thus receives a more intense or concentrated wash that other areas of the lower rack 32. Furthermore, the silverware spray zones 68, 70 may overlap each other to ensure that the entire silverware basket 34 is exposed to a spray of liquid. Since the silverware spray zones 68, 70 can be been designed to allow silverware to receive the traditional wash provided by the lower spray arm 44, as well as additional wash action from the dedicated sprayer 50, the dishwasher 10 may not only provide better washing performance for silverware, but may provide overall improved wash performance.

Figure 7:
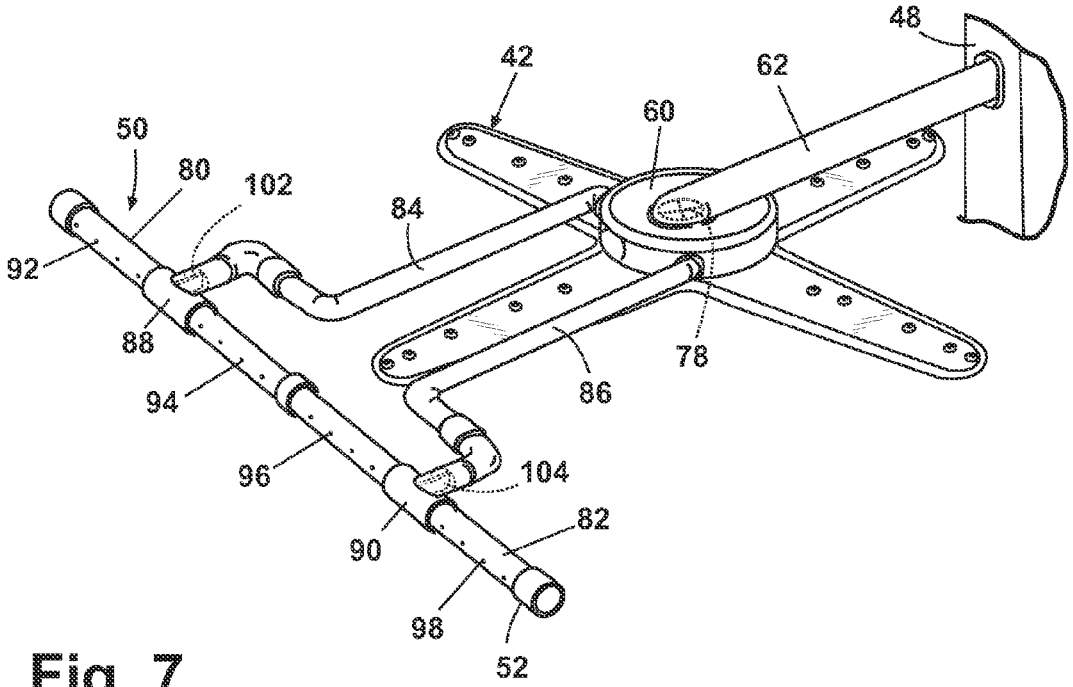
FIG. 7 is a perspective view of a dedicated sprayer in accordance with a second embodiment of the invention.

FIG. 7 is a perspective view of a dedicated sprayer 50 in accordance with a second embodiment of the invention, in which like elements are identified using the same reference numerals. For the second embodiment of the dedicated sprayer 50, the spray head 52 is divided into two segments 80, 82, with each segment 80, 82 in liquid communication with a different manifold tube 84, 86. Both manifold tubes 84, 86 are in fluid communication with the manifold hub 60. The spray head 52 can be physically mounted to an end of the manifold tubes 84, 86 by couplers 88, 90. A first set of orifices 92 can be formed in the right-hand segment 80 to the left of the coupler 88, a second set of orifices 94 can be formed in the right-hand segment 80 to the right of the coupler 88, a third set of orifices can be formed in the left-hand segment 82 to the left of the coupler 90, and a fourth set of orifices can be formed in the left-hand segment 82 to the right of coupler 90.

The dedicated sprayer 50 can employ two-stages of valves to control delivery of liquid to the upper spray arm 42 and the dedicated sprayer 50, and to different subportions of the silverware basket 34. Like the first embodiment, a first valve 78 can be positioned in the manifold hub 60 and is selectively controlled to direct a portion of the liquid being delivered to the upper spray arm to one of the manifold tubes 84, 86. The valve 78 can further close liquid flow to both manifold tubes 84, 86, so that liquid is only supplied to the upper spray arm 42 and not to the dedicated sprayer 50. A second valve 102 can be positioned in the spray head 52 or the manifold tube 84 and is selectively controlled to direct liquid to one of the first set of orifices 92 or the second set of orifices 94. A third valve 104 can be positioned in the spray head 52 or the manifold tube 86 and is selectively controlled to direct liquid to the one of the third set of orifices 96 or the fourth set of orifices 98. Optionally, instead of stages of valves, a multi-position valve or a sequencing valve could be employed.

Figure 8:
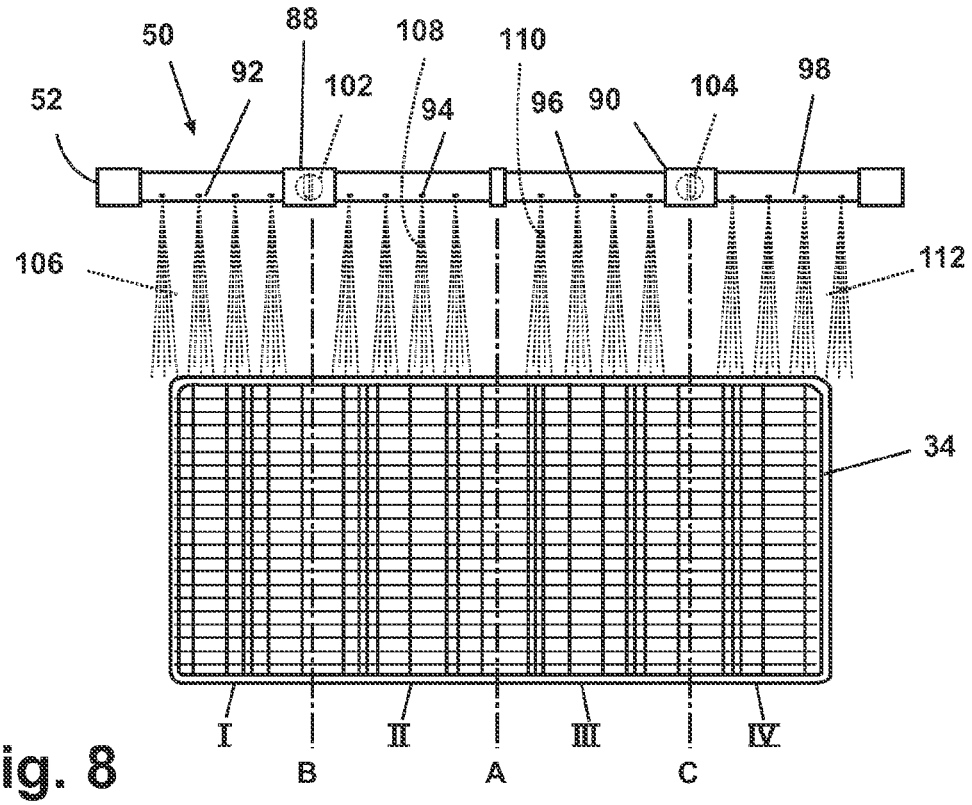
FIG. 8 is a schematic front view of the dedicated sprayer and the silverware basket, illustrating the spray zones of the dedicated sprayer of FIG. 7.

FIG. 8 is a schematic view of the dedicated sprayer 50 and the silverware basket 34, illustrating the spray zones of the dedicated sprayer 50 of FIG. 7. Conceptually, the silverware basket 34 can be divided into four subportions I, II, III, IV as indicated by planes A, B and C extending through the silverware basket 34. The dedicated sprayer 50 has four spray zones, one for each subportion I, II, III, IV. The first set of orifices 92 dispense a stream of wash liquid toward the first subportion I to form a first silverware spray zone 106, the second set of orifices 94 dispense streams of wash liquid toward the second subportion II to form a second silverware spray zone 108, the third set of orifices 96 dispense streams of wash liquid toward the third subportion III to form a third silverware spray zone 110, and the fourth set of orifices 98 dispense streams of wash liquid toward the fourth subportion IV to form a fourth silverware spray zone 112. The valves 78, 102, 104 can selectively control which orifices receive liquid, and therefore controls which silverware spray zone, if any, is active. Optionally, the valves 78, 102, 104 can be controlled so that each silverware spray zone is sequentially activated in a repeating cycle.

Figure 9:
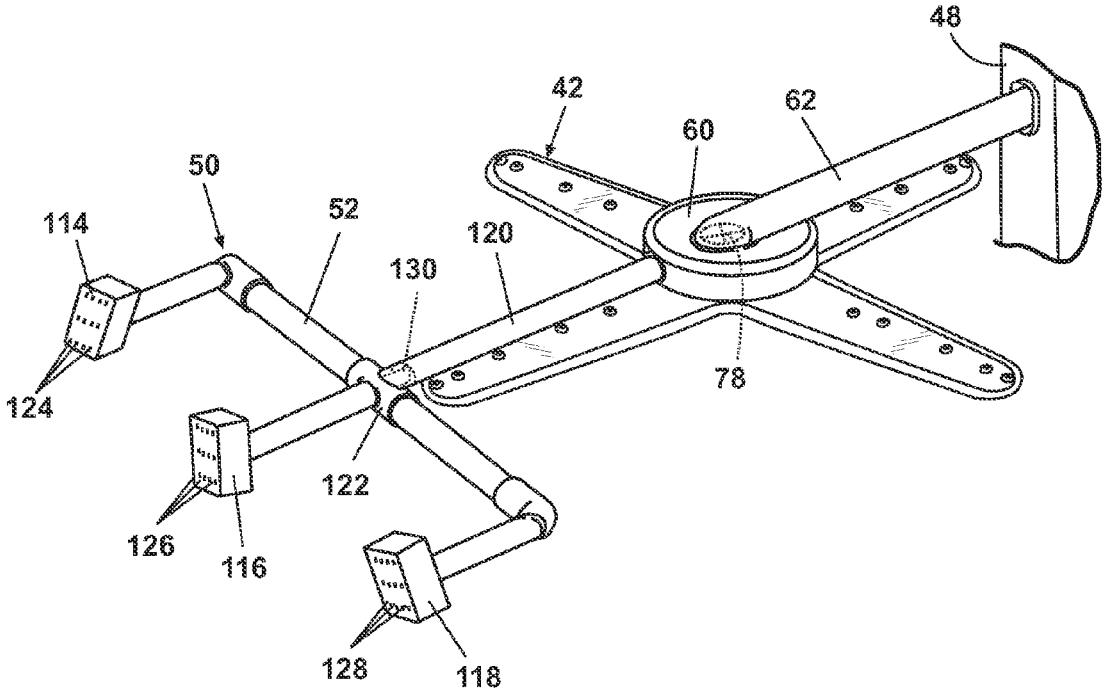
FIG. 9 is a perspective view of a dedicated sprayer in accordance with a third embodiment of the invention.

FIG. 9 is a perspective view of a dedicated sprayer 50 in accordance with a third embodiment of the invention, in which like elements are identified using the same reference numerals. For the third embodiment of the dedicated sprayer 50, the spray head 52 comprises three nozzles 114, 116, 118 in fluid communication with a single manifold tube 120. The spray head 52 can be physically mounted to the end of the manifold tube 120 by a coupler 122. Each nozzle 114, 116, 118, which may be a fluidic nozzle, comprises a set of orifices 124, 126, 128, respectively. A three-position valve 130 can be located in the spray head 52 or the manifold tube 120 and is selectively controlled to direct liquid to one of the nozzles.

Figure 10:
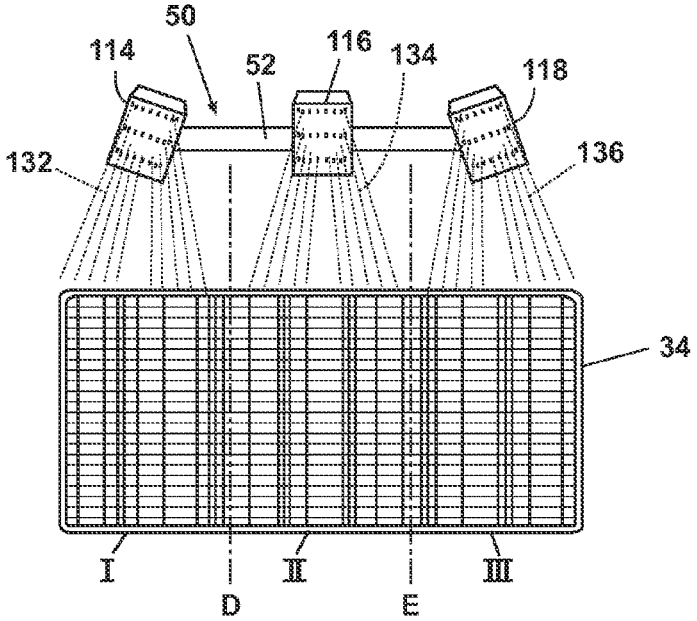
FIG. 10 is a schematic front view of the dedicated sprayer and the silverware basket, illustrating the spray zones of the dedicated sprayer of FIG. 9.

FIG. 10 is a schematic view of the dedicated sprayer 50 and the silverware basket 34, illustrating the spray zones of the dedicated sprayer of FIG. 9. Conceptually, the silverware basket 34 can be divided into three subportions I, II, III as indicated by planes D and E extending through the silverware basket 34. The dedicated sprayer 50 has three spray zones, one for each subportion I, II, III. The orifices 124 of the left-hand nozzle 114 dispense a stream of wash liquid toward the first subportion I to form a first silverware spray zone 132, the orifices 126 of the center nozzle 116 dispense streams of wash liquid toward the second subportion II to form a second silverware spray zone 134, and the orifices 128 of the right-hand nozzle 118 dispense streams of wash liquid toward the third subportion III to form a third silverware spray zone 136. The valve 130 can selectively control which orifices receive liquid, and therefore controls which silverware spray zone is active. Optionally, the valve 130 can be controlled so that each silverware spray zone 132, 134, 136 is sequentially activated in a repeating cycle.

Figure 11:
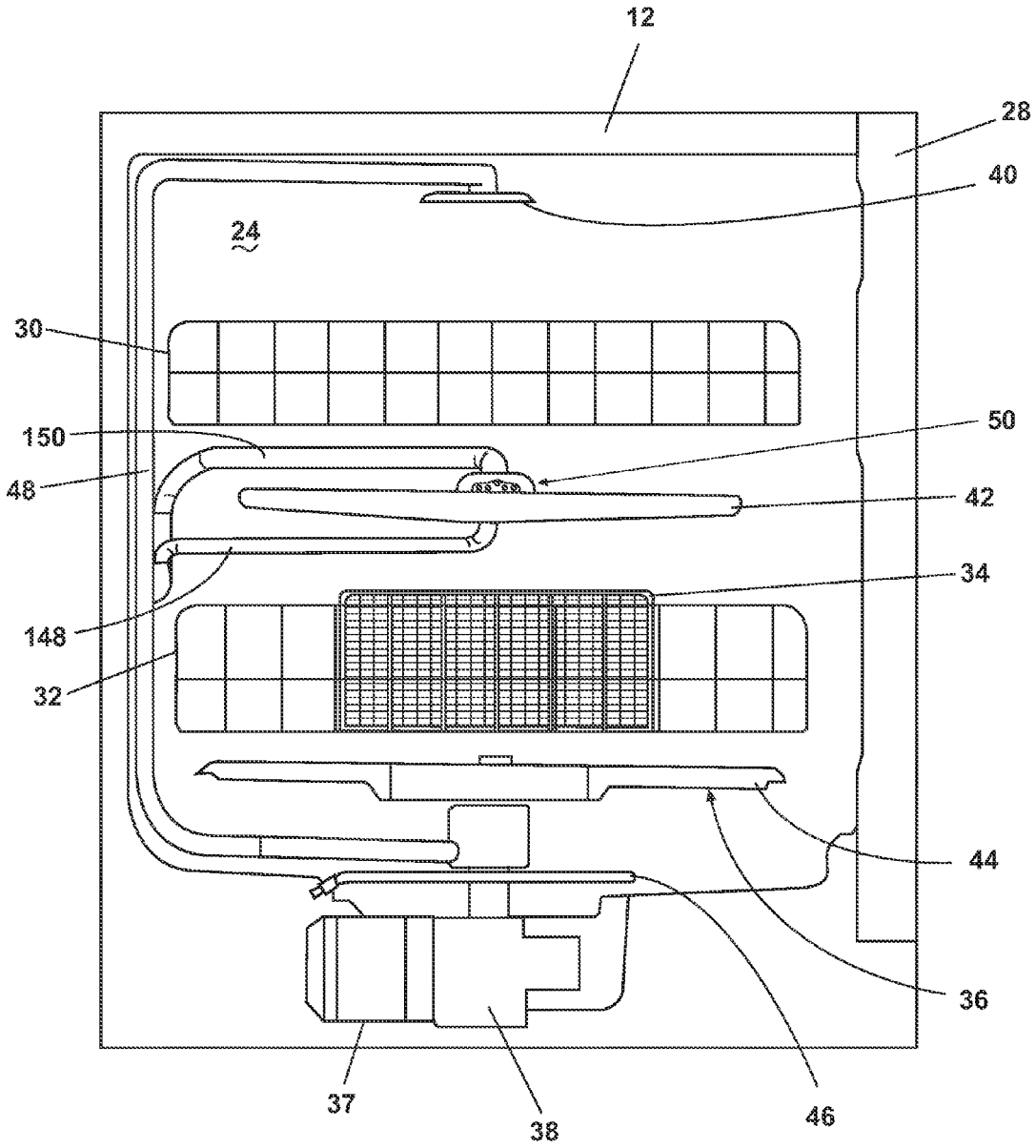
FIG. 11 is a schematic, side-sectional view of a dishwasher having a dedicated sprayer in accordance with a fourth embodiment of the invention.

FIG. 11 is a schematic, side-sectional view of a fourth embodiment of an automatic dishwasher 10, in which like elements are identified using the same reference numerals. For the fourth embodiment of the dishwasher 10, the silverware basket 32 is positioned along a peripheral side of the lower rack 32 that is parallel to the one of the side walls 20 of the wash tub 14. Optionally, the silverware basket 34 could be positioned along a peripheral side of the lower rack 32 that is parallel to the rear wall 22 or the door 28 when in the closed position.

Figure 12:
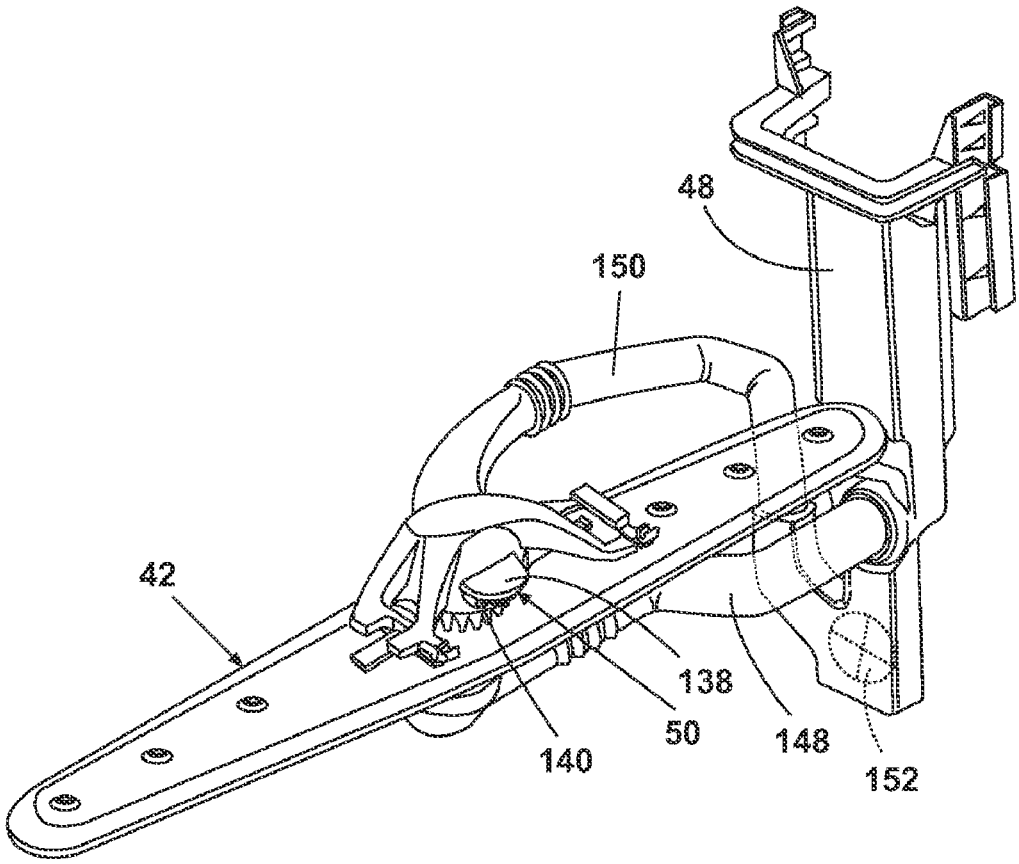
FIG. 12 is a perspective view of the dedicated sprayer from FIG. 11.

FIG. 12 is a perspective view of the dedicated sprayer of the fourth embodiment. The dedicated sprayer 50 may comprise a spray head 138 having one or more nozzles or orifices 140 for dispensing a stream of liquid forming a spray. While the supply tube 48 ultimately supplies liquid to the both the upper spray arm 42 and dedicated sprayer 50, each sprayer 42, 50 fluidly communicate with separate manifold tubes that directly transport liquid to the sprayers 42, 50. The upper spray arm 42 is in fluid communication with a first manifold tube 148 branching off the supply tube 48, and the spray head 138 is in fluid communication with a second manifold tube 150, which separately branches off the supply tube 48. A valve 152 can be positioned within the supply tube 48 to selectively direct all or a portion of the liquid to either manifold tube 148, 150. The valve 152 can function as discussed previously, and can comprise any of the various types of valves disclosed herein. In one contemplated utility, the valve 152 is controlled so that liquid is routed to the dedicated sprayer 50 by opening the path to the second manifold tube 150 and closing the first manifold tube 148 during a specific phase of an operation cycle of the dishwasher 10, such as a silverware treating phase. During the silverware treating phase, liquid is not sprayed form the upper spray arm 42, so that a great amount of liquid can be devoted to spraying the silverware basket 34.

The spray head 138 can be optionally be a movable spray head 138 that is moveably mounted to the manifold hub 60 of the upper spray arm 42. In the illustrated embodiment, the spray head 138 is rotatable between different positions, where each position corresponds to a different silverware spray zone. Optionally, the dedicated sprayer 50 can be controlled so that each silverware spray zone is sequentially activated in a repeating cycle.

Figure 13A:
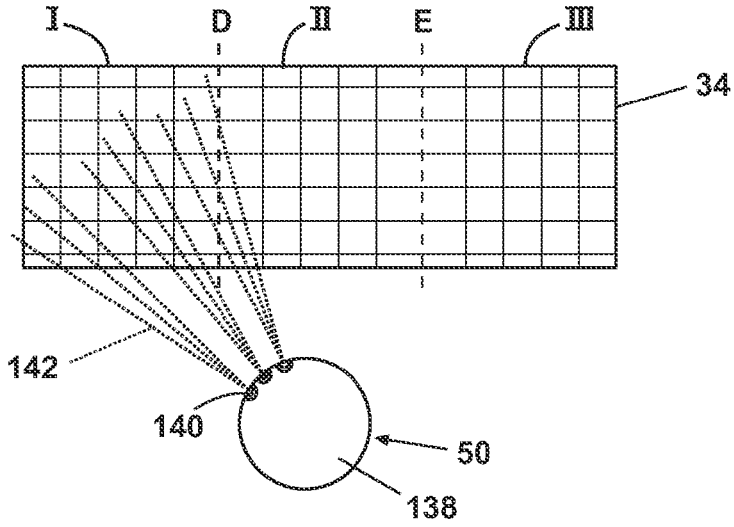
FIGS. 13A-C are schematic, top views of the dedicated sprayer and the silverware basket, illustrating the spray zones of the dedicated sprayer of FIG. 11.
Figure 13B:
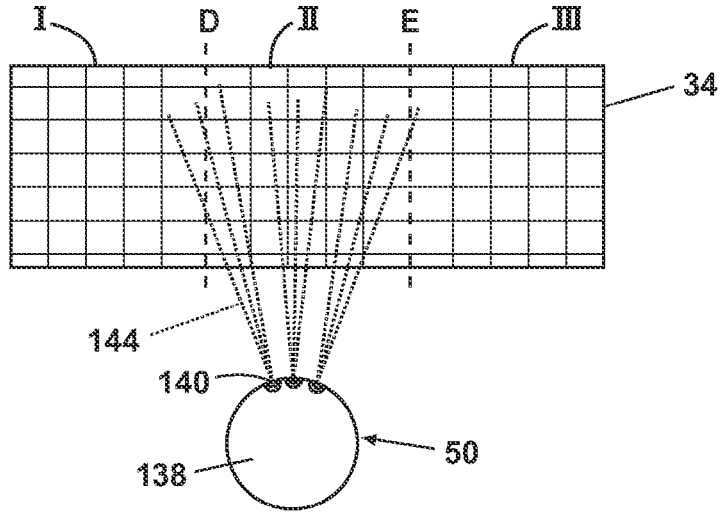
Figure 13C:
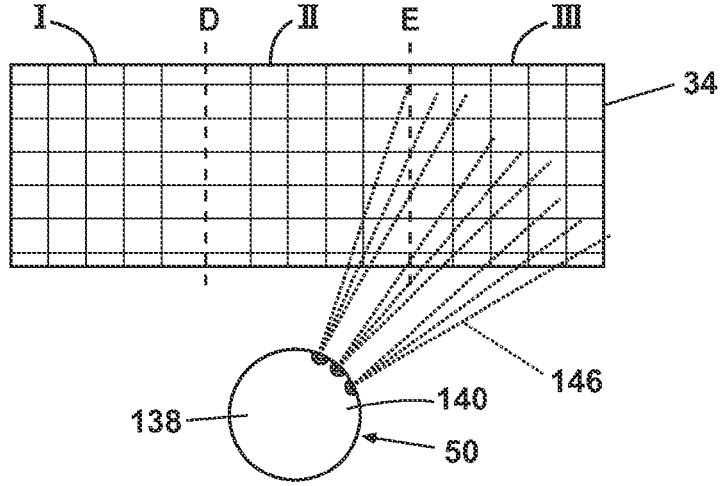

FIGS. 13A-C are schematic, top views of the dedicated sprayer 50 and the silverware basket 34, illustrating the spray zones of the dedicated sprayer of FIG. 11. Conceptually, the silverware basket 34 can be divided into three subportions I, II, III as indicated by planes D and E extending through the silverware basket 34. The dedicated sprayer 50 has three spray zones, one for each subportion I, II, III. The spray head 138 rotates to a first position, shown in FIG. 13A, to dispense a stream of wash liquid toward the first subportion I to form a first silverware spray zone 142. The spray head rotates to a second position, shown in FIG. 13B, to dispense a stream of wash liquid toward the second subportion II to form a second silverware spray zone 144. The spray head rotates to a third position, shown in FIG. 13C, to dispense a stream of wash liquid toward the third subportion I to form a third silverware spray zone 146. Optionally, the spray head 138 can be controlled to sequentially move between the first, second and third positions so that each silverware spray zone is sequentially activated in a repeating cycle.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher comprising:

a tub defining a wash chamber;

a rack provided in the wash chamber for holding dishes for washing;

a stationary silverware basket located in the wash chamber;

a stationary dedicated sprayer for the silverware basket located in the tub and having multiple, independently operable spray zones, each spray zone corresponding to and directed toward a different subportion of the silverware basket;

a liquid supply system fluidly coupled to the dedicated sprayer and cycling a supply of liquid between each of the multiple spray zones to spray the corresponding subportion of the silverware basket such that the entire silverware basket is sprayed one subportion at a time.

2. The automatic dishwasher according to claim 1, wherein the silverware basket is located in a door.

3. The automatic dishwasher according to claim 1 and further comprising a rotating spray arm located in the wash chamber and providing a liquid spray toward the rack to define a generalized spray zone for the entire rack.

4. The automatic dishwasher according to claim 1, wherein the dedicated sprayer comprises an elongated spray head with multiple orifices.

5. The automatic dishwasher according to claim 1 wherein the liquid supply system comprises a valve system selectively operable to control the cycling of the supply of liquid between each of the multiple spray zones.

6. The automatic dishwasher according to claim 1 wherein the tub comprises an open face providing access to the wash chamber and a door for selectively closing the open face.

7. The automatic dishwasher according to claim 3, wherein the silverware basket is located in the rack.

8. The automatic dishwasher according to claim 3, wherein the liquid supply system further comprises a valve for selectively controlling the supply of liquid to one of the rotating spray arm and the dedicated sprayer.

9. The automatic dishwasher according to claim 3, wherein at least one of the multiple spray zones at least partially intersects the generalized spray zone.

10. The automatic dishwasher according to claim 4, wherein the elongated spray head is vertically positioned above the silverware basket.

11. The automatic dishwasher according to claim 4, wherein the liquid supply system further comprises a valve for selectively controlling the supply of liquid to different orifices to produce each of the multiple spray zones.

12. A method for delivering liquid to a stationary silverware basket of a dishwasher having a tub defining a wash chamber, a rack for holding dishes located in the wash chamber, a rotatable spray arm providing a generalized spray of liquid to the rack, and a stationary dedicated sprayer for the silverware basket, the silverware basket being located in the wash chamber, the method comprising:

emitting a spray of liquid from the stationary dedicated sprayer from independently operable spray zones toward the stationary silverware basket, with each of the spray zones corresponding to a different subportion of the silverware basket to spray the entire silverware basket with liquid; and cycling the emitting a spray of liquid between the independently operable spray zones to spray the entire silverware basket one subportion at a time.

13. The method according to claim 12 wherein the cycling of the emitting a spray of liquid from the dedicated sprayer toward different subportions of the silverware basket comprises sequentially emitting a spray of liquid toward each different subportion.

14. The method according to claim 12 wherein the emitted spray of liquid from each of the zones has a greater velocity for a given supply of liquid to the dedicated sprayer than a simultaneously emitted spray of liquid from all of the zones for the given supply of liquid to the dedicated sprayer.

15. The method according to claim 12 and further comprising emitting a spray of liquid from a rotating spray arm located in the wash chamber, wherein a common liquid supply supplies both the dedicated sprayer and the rotating spray arm.

16. The method according to claim 12 wherein the emitting a spray of liquid from the stationary dedicated sprayer occurs when no spray is being emitted from the rotatable spray arm.

17. The method according to claim 15 wherein the sprays of liquid from the dedicated sprayer and the rotating spray arm are simultaneously emitted.

18. The method according to claim 15 wherein the sprays of liquid from the dedicated sprayer and the rotating spray arm are alternately emitted.

19. The method according to claim 15 wherein the spray of liquid from the rotating spray arm is continuously emitted while the spray of liquid from the dedicated sprayer is selectively emitted.

* * * * *